US006526779B2

(12) United States Patent
Foote

(10) Patent No.: US 6,526,779 B2
(45) Date of Patent: Mar. 4, 2003

(54) WIDOW AND WIDOWER RING AND IDENTIFICATION SYSTEM

(76) Inventor: Harold R. Foote, 27 Twin Brook La., Bedford, NH (US) 03110

( * ) Notice: Subject to any disclaimer, the term of this patent is extended or adjusted under 35 U.S.C. 154(b) by 0 days.

(21) Appl. No.: 09/906,407

(22) Filed: Jul. 16, 2001

(65) Prior Publication Data

US 2002/0011078 A1 Jan. 31, 2002

Related U.S. Application Data

(60) Provisional application No. 60/219,092, filed on Jul. 18, 2000.

(51) Int. Cl.[7] ..... A44C 19/00

(52) U.S. Cl. ..... 63/15; 63/1.11; 63/1.16; 63/15.2

(58) Field of Search ..... 63/1.11, 1.16, 63/15, 15.1, 15.2

(56) References Cited

U.S. PATENT DOCUMENTS

| | | | | | |
|---|---|---|---|---|---|
| 530,522 | A | * | 12/1894 | Hattenback | 607/145 |
| D53,040 | S | * | 3/1919 | Krope | D11/39 |
| 1,303,530 | A | * | 5/1919 | Zix | 29/896.412 |
| 2,128,644 | A | * | 8/1938 | Gittler | 63/15 |
| 2,146,426 | A | * | 2/1939 | Gittler | 63/15 |
| 2,208,019 | A | * | 7/1940 | Darling | 40/649 |
| 4,195,493 | A | * | 4/1980 | Bogner et al. | 63/15 |
| 4,226,094 | A | | 10/1980 | Wolpoff | |
| 4,311,026 | A | * | 1/1982 | Ochoa | 63/15 |
| 4,493,196 | A | * | 1/1985 | Bogner et al. | 63/15 |
| 5,161,392 | A | | 11/1992 | Wiriath et al. | |
| 5,419,158 | A | | 5/1995 | Sandberg et al. | |
| 5,596,887 | A | | 1/1997 | Bergagnini | |
| 5,806,344 | A | | 9/1998 | Bonchek | |
| 5,865,042 | A | * | 2/1999 | Cerqua | 63/1.11 |
| 6,032,498 | A | | 3/2000 | Steinberg | |

* cited by examiner

*Primary Examiner*—J. J. Swann
*Assistant Examiner*—Andrea Chop
(74) *Attorney, Agent, or Firm*—Maine & Asmus

(57) ABSTRACT

An article of jewelry, namely a combination of two wedding rings, wherein the wedding rings are stacked upon each other and fixedly attached. In a preferred embodiment the two wedding rings are oriented concentrically using reverse jeweler's tweezers or cones. The rings are joined together, and in one embodiment gold brazing joins the rings. The wedding rings worn in such a fashion identify that the person is widowed and is a method of signifying widow and widower status without causing confusion, embarrassment or discomfort.

4 Claims, 3 Drawing Sheets

WIDOW AND WIDOWER RING AND IDENTIFICATION SYSTEM

CROSS REFERENCE TO RELATED APPLICATIONS

This application relates to and claims priority to pending U.S. application serial No. 60/219,092, filed Jul. 18, 2000.

TECHNICAL FIELD OF THE INVENTION

The present invention relates to the field of jewelry, and more particularly to using a style of jewelry as a means of signifying the person is a widow or widower. Even more particularly, the present invention relates to combining the wedding ring of the surviving spouse and the wedding ring of the deceased to form a single double band ring, wherein the ring signifies that the person is a widow or widower.

BACKGROUND OF THE INVENTION

Based on statistics from the U.S. Bureau of the Census for 1998, almost half of all women 65 years of age or older were widows. There were approximately 8.4 million widows and 2.0 million widowers.

And, the population of those over age 65 is growing significantly. Estimates indicate that by 2030 there will be about 70 million persons over the age of 65—more than double the number of 1998! According to current estimates, there are about 880,000 widows and widowers per year. With such a drastic increase in older persons, the number of widows and widowers will increase dramatically.

As a result of medical technology and improved diagnostic and treatment procedures, the average life expectancy also continues to increase. The genome research is reportedly going to impact the next generation and extend life expectancy and the quality of life. Some scientists expect the life expectancy to advance rapidly and even be in the 100's within the next few decades.

Such extended life expectancy alters the lifestyles and planning for everyone. Besides the obvious financial impact of living longer, there is also a tremendous social impact. A person that remains healthy can have a dynamic work and social life for a much longer period.

Despite the increase in the average life expectancy, science has not figured out how to prevent aging and dying. New diseases continue to befuddle the medical community and new strains of existing diseases will likely continue to keep the medical profession scrambling.

In addition, science can do little to prevent accidents. People will continue to die from the various accidents and catastrophes that are commonplace in our society. Car accidents alone take a significant toll in human life without even considering the effects from floods, earthquakes, and other natural disasters.

This means that some married persons will not get to experience old age together as husband and wife. The number of widows and widowers is significant and will increase rapidly. These living spouses that have lost their mate will be living longer and healthier.

Some of these widows and widowers may not wish to spend the latter part of their life alone. They may be in good physical and mental condition and have a long period of time before they pass on. Many will want a social life and mingle with others rather than be alone.

Besides the bereavement groups, there are a number of groups that promote socialization for widowed persons.

There are even a growing number of Internet sites promoting social events for widows and widowers. This expanding widowed population does not want to sit at home, they want to meet people that may share similar interests and hobbies.

In addition to the social aspects, many of these widows and widowers also may enjoy a satisfying sex life. Many persons remain active for many years, and the introduction of Viagra and similar treatments can aid in promoting an active sex life.

Despite the growing demand for social activities for widows and widowers, it is not an easy transition. There are very few events or social places that widows and widowers tend to gather. Based on the age, it may be assumed that the person is married, as there is no manner to signify that the person is widowed. A single person will not have a wedding ring and many people tend to note such items. A married person generally will have a wedding ring. But, a widowed person may or may not wear the ring, making identification difficult. Thus, identifying widowed persons may be very difficult in a social setting.

In addition, the widows and widowers still cherish the departed. There have many happy memories and find it painful to part with the past. For example, widows and widowers do not know what to do with the wedding ring worn by the spouse. According to statistics, a majority of deceased persons are buried with their wedding rings. Those that keep the ring of the deceased seldom figure out where to place it or what to do with the ring.

Besides the ring of the deceased, the widowed person also experiences some uneasiness as to their own wedding ring. Some widowed persons continue to wear the ring, and have to run the risk of uncomfortable situations by being asked the status of their spouse. Those that decide to remove the ring feel great pangs of guilt and sorrow. The ring is more than a piece of metal—it is a symbol of the relationship and the bonding between the persons. It may be worn for many years and cause much discomfort in having to now remove the ring.

Therefore, there are many reasons for a new ring design to help the widowed person by aiding in the bereavement process. The grieving widowed person wants to memorialize the deceased and needs some assistance in figuring out what to do with the ring of the deceased as well as what to do with their own ring.

In addition, the widowed persons desire some way to locate those that may be in a similar situation. Rings have always been used as an identifier, such as those worn by fraternal organizations and societies. Persons have become accustomed to noting certain rings as an identifier. A new ring design can help distinguish widowed persons and establish a system of identifying widows and widowers.

The prior art discusses a number of different ring designs. U.S. Pat. No. 4,226,094 shows a finger ring comprising a series of circular sections slightly resembling wedding bands—which are interconnected by threading each assembly to extend the surface of the ring allowing quick change in ring size and design modifications.

There were several rotatable rings that allow a portion of the ring to freely rotate. The ring disclosed in U.S. Pat. 5,161,392 is such a ring, and an outer band spins freely about an inner ring.

Locking rings were also disclosed, particularly mating engagement rings with wedding rings, such as those issued to inventor Bonchek. In U.S. Pat. No. 5,806,344, one of the rings employs a track or channel and the other ring mates with the channel to join the rings.

Another rotatable ring was shown in U.S. Pat. No. 6,032,485 in which a segment of the inner ring can be covered. In this invention the expensive stone on the inner surface can be covered with an outer design.

Wrap rings were illustrated in U.S. Pat. Nos. 5,596,887 and 5,419,158, wherein one or more rings are interconnected on the same plane. The rings each have some mating characteristics and use some type of fastening mechanism, such as a locking pin or retention snap fit.

None of the prior art ring designs have addressed the aforementioned problems. What is needed is a means of identifying a widowed person. Such a means may encourage and promote social activity and enable the widowed person to enjoy some companionship and friendship. Such a system should also pay respect to the deceased and allow the living spouse to commemorate their dearly departed yet lower their guilt and unease. The ring system should be cost effective and easily identifiable.

SUMMARY OF THE INVENTION

Accordingly, an object of the present invention is a means of identifying widowed persons. In one embodiment a widow wears the ring on the third finger of the right hand, while a widower wears the ring on the little finger of the left hand.

One embodiment of the invention is a connecting of the wedding bands by vertically orienting the rings and affixing the rings together. The rings can be tack brazed/welded or affixed by an adhesive. It is important to ensure the rings are properly aligned, so tweezers or conical fixtures can be used.

Another object is a means of providing some guidance to widowed persons on the proper disposition of the wedding rings. It also helps to relieve some guilt and emotional grief associated with losing the spouse by wearing a memorial every day.

With respect to the jewelry marketplace, the concept of the widow and widower rings represents a tremendous opportunity. The jewelry market benefits not only for the services involved in joining the rings, but also the ancillary sales in additional jewelry and repairs. The jewelry services involved in joining the rings are minimal, and can be done fairly quickly and at low cost. But, the value to the customer would be great, and a price premium can be expected.

As previously stated herein, most wedding rings might have been buried with the deceased or otherwise disposed of, requiring a new ring purchase. The rings may also require re-sizing or other types of repair or inscription requiring additional fees for services.

Anytime a person enters into a store there is a greater likelihood that the person will see something and buy it on an impulse. Such impulse sales would be significant, as the widowed consumer is generally a little older and affluent. These persons would not generally go to the jewelry store, so the traffic increase represents a completely new market. And, because the work can be done on premises, multiple trips may be required resulting in more traffic. Alternatively, it is possible to perform the work while the person waits, resulting in a captive customer that may wander the store.

There are numerous ways to promote the concept of the widowed ring, especially through the various magazines and journals that cater to the retirement community. Older spokespersons and radio ads are likely also a good means of targeting the proper audience. Once the concept is acknowledged and gains in popularity, the widow or widower ring may become the custom such as the wedding ring used to note married persons. It may be helpful to the bereaved spouse to be provided by the funeral director with a tastefully prepared one page sheet of instruction of the new custom.

One object of the invention is a ring for a widowed person, comprising a pair of first and a second substantially circular wedding rings, wherein the first and second wedding ring have an external face, an internal face, and a pair of side ends. And, wherein the first and second wedding rings are fixedly attached in a concentric orientation and secured at the side ends.

In one embodiment the first and second wedding rings are fixedly attached by a plurality of tack welds. There can be gold braze used to fill a seam between the first and second wedding rings to provide a smooth finish.

Another object of the invention is a method for forming a widowed ring comprising the steps of concentrically aligning a first wedding ring with a second wedding ring using an alignment tool, and affixing the first wedding ring to the second wedding ring.

In one embodiment the step of affixing is tack welding. The alignment tool can be a conical device upon which the first and second wedding ring is disposed thereby aligning the rings coaxially. Another alignment tool is a pair of jeweler's reverse tweezers, which holds the first and second wedding ring in concentric alignment.

A further object includes the step of filling a seam between the first and second wedding rings with braze. The step of affixing includes soldering and gluing.

Yet another object is the step of resizing the first and second ring. The resizing can ensure that the two rings of different size are sized to fit the wearer.

A final object of the invention is a method for identifying a widowed person comprising the step of wearing a widowed ring, wherein the widowed ring is a combination of a first and second wedding ring concentrically joined.

Still other objects and advantages of the present invention will become readily apparent to those skilled in this art from the following detailed description, wherein only a preferred embodiment of the invention is described, simply by way of illustration of the best mode contemplated for carrying out the invention. As will be realized, the invention is capable of other and different embodiments, and its several details are capable of modifications in various obvious respects, all without departing from the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF THE PREFERRED EMBODIMENT

The present invention features a pair of wedding rings concentrically joined to create a widowed ring. Such a ring provides a means of communicating the widowed status to others merely by wearing the ring.

Figure 1A:
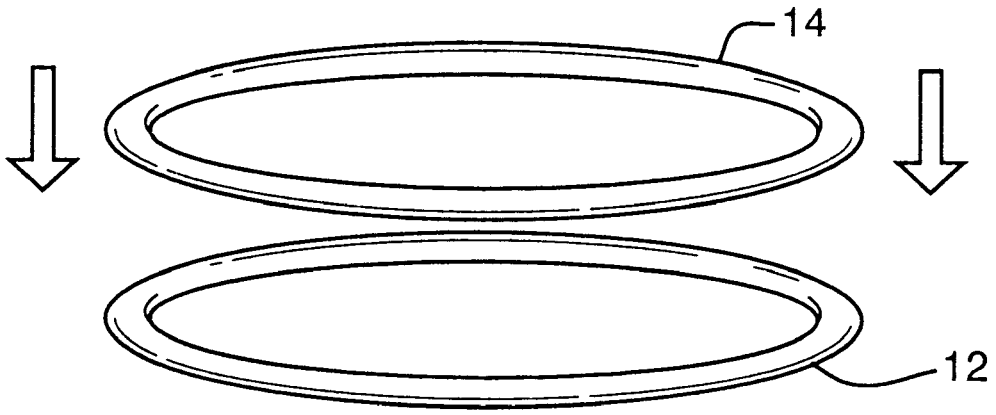
FIG. 1A is a side perspective view of two separate wedding rings being joined
Figure 1B:
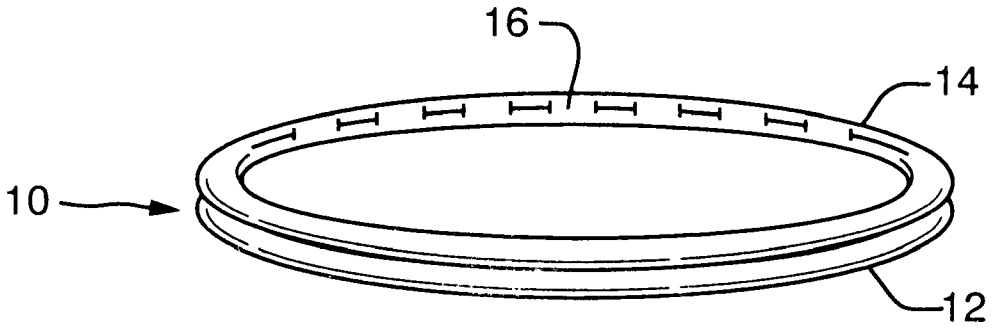
FIG. 1B illustrates the joined wedding rings secured together
Figure 2:
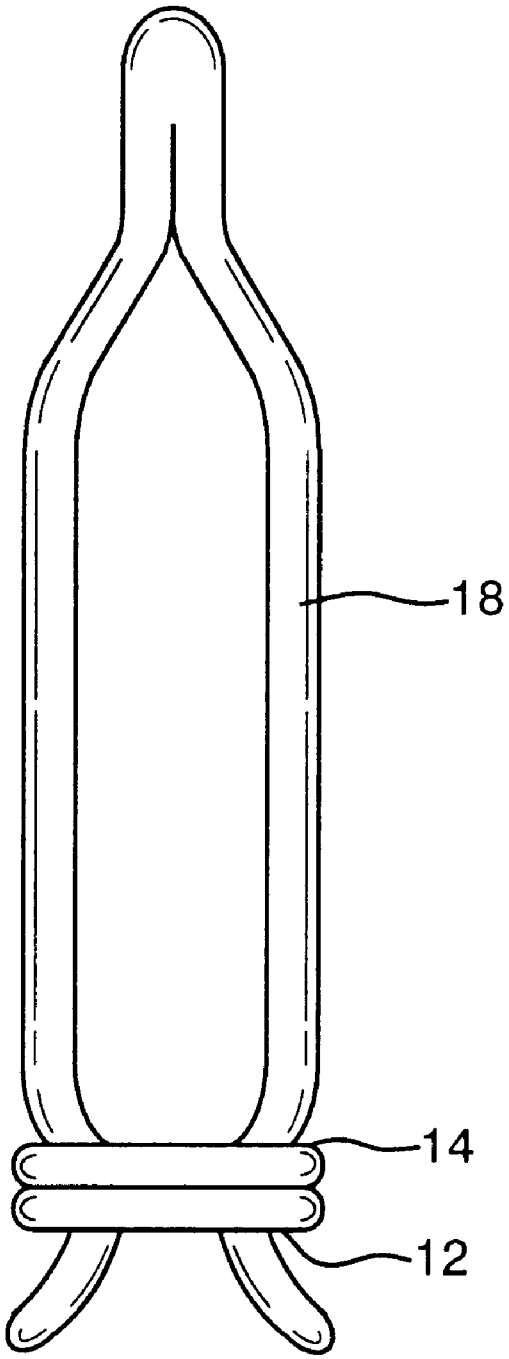
FIG. 2 shows the jewelers tweezers holding the wedding rings in proper orientation for securing

As shown in FIG. 1A and FIG. 1B, the wedding rings are vertically disposed, one on top of the other. The larger ring 12 is easier to place on the bottom and the narrower ring 14 on the top to position properly. In one embodiment, as illustrated in FIG. 2, a pair ofjeweler's reverse tweezers 18 are used to keep the rings in the proper position. The jeweler's tweezers are normally expanded and have a force pushing the tweezers legs apart. The tweezers are squeezed together and the rings (12, 14) are placed over the tweezers, and as you release the tweezers, the pressure is applied to keep the rings properly spaced.

Another manner to position the wedding rings is to use a conical shaped device 20 with a narrow end and a wider end, wherein the narrow end slowly increases to the wider end. The conical shaped device must be somewhat fire retardant in order to take the soldering or brazing process.

To achieve an acceptable fit, one or both of the rings may require resizing. For widows, this resizing would be minimal, at most decreasing the size of her late husband's ring if that ring were exceptionally large. For widower's both rings may require resizing, as the man's ring finger is likely larger than his little finger, and his late wife's ring finger may have been of different size than his little finger.

The rings can be joined in a number of different ways. For example, applying gold brazing equidistant from the tweezers contact. Besides brazing, the rings can be soldered or even joined by an adhesive. In a preferred embodiment 10 illustrated in FIG. 1B the rings are tacked welded in a number of places 16 between the tweezers position and the lips between rings are filled with gold braze. It may also be necessary to re-size the combined rings in order to have a proper fit.

One preferred device for holding the rings together is jewelers reverse tweezers 18 as shown in FIG. 2. These tweezers place the rings of varying sizes in contact with each other and permit brazing or soldering.

Figure 3:
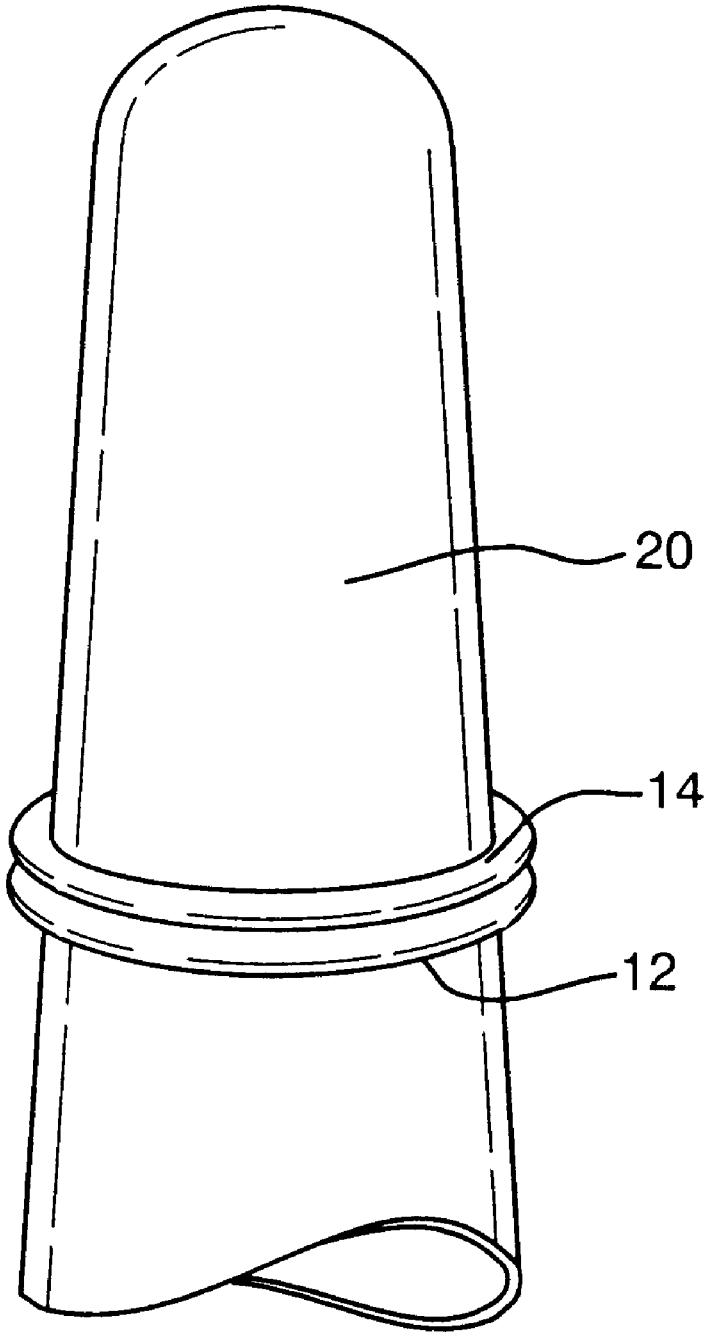
FIG. 3 shows a cone being used to keep the two wedding rings in proper orientation for securing

FIG. 3 shows an alternate means to place the rings in proximity for welding; a conical shaped device 20. These various jigs ensure that the rings are coaxially aligned with each other for aesthetic reasons and also for comfort.

Once the rings are combined, the widowed person may now help others identify them as widowed persons and avoid awkward and embarrassing questions. The widow wears the ring on the right ring finger while the widower wears the ring on the left little finger.

In this manner, the surviving spouse aids in the grieving process by allowing the spouse to express their status as a widowed person. The combined rings are attractive and a fitting memorial for the deceased. Other persons can identify the person as a widow or widower, which will increase the social atmosphere.

The present invention has been particularly shown and described with respect to certain preferred embodiments of features. However, it should be readily apparent to those of ordinary skill in the art that various changes and modifications in form and details may be made without departing from the spirit and scope of the invention. Additional objects and advantages of the present invention may be further realized and attained by means of the instrumentalities and combinations all within the scope of the claims. The drawings and description are to be regarded as illustrative in nature, and not as restrictive.

What is claimed is:

1. A method of identifying a widowed person comprising the steps of:

creating a widowed ring, wherein creating the widowed ring further comprises the steps of:

providing a first substantially circular wedding ring that belonged to the widowed person, said first substantially circular wedding ring further having a first diameter, a first external face, a first internal face and a first pair of side ends, providing a second substantially circular wedding ring that belonged to a deceased spouse of the widowed person, said second substantially circular wedding ring further having a second diameter, a second external face a second internal face and a second pair of side ends, resizing the second substantially circular wedding ring, wherein the second diameter is resized approximately equal to the first diameter, fixedly attaching one side end of said first substantially circular wedding ring to one side end of said resized second substantially circular wedding ring to create a single ring structure, and wearing said widowed ring.

2. The method for identifying as a widowed person according to claim 1, wherein said first and second substantially circular wedding rings are fixedly attached by a plurality of tack welds.

3. The method for identifying as a widowed person according to claim 1, and wherein gold braze is used to fill a seam between said first and second substantially circular wedding rings to provide a smooth finish.

4. The method for identifying as a widowed person according to claim 1 wherein said first and second substantially circular wedding rings are fixedly attached by soldering.

* * * * *